US007407456B2

(12) United States Patent
Price et al.

(10) Patent No.: US 7,407,456 B2
(45) Date of Patent: Aug. 5, 2008

(54) OFFSET LACROSSE HEAD

(75) Inventors: Joel F. Price, Chevy Chase, MD (US); Richard B. C. Tucker, Jr., Baltimore, MD (US)

(73) Assignee: STX, LLC, Baltimore, MD (US)

( * ) Notice: Subject to any disclaimer, the term of this patent is extended or adjusted under 35 U.S.C. 154(b) by 159 days.

(21) Appl. No.: 11/200,004

(22) Filed: Aug. 10, 2005

(65) Prior Publication Data

US 2007/0004541 A1 Jan. 4, 2007

Related U.S. Application Data

(60) Provisional application No. 60/600,794, filed on Aug. 12, 2004.

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512, 513, 560; 600/562; 403/10, 59, 403/334; D21/724; 248/188.5; 482/107; 474/56; 285/7
See application file for complete search history.

(56) References Cited

U.S. PATENT DOCUMENTS

| | | | | |
|---|---|---|---|---|
| 750,343 | A * | 1/1904 | Brockway | 231/6 |
| 1,459,389 | A | 6/1923 | Brown | |
| 2,679,911 | A * | 6/1954 | Bhend | 52/298 |
| 2,935,323 | A | 5/1960 | Cummings | |
| 3,545,755 | A | 12/1970 | Owada | |
| 3,822,062 | A | 7/1974 | Tucker et al. | |
| 4,037,841 | A | 7/1977 | Lewis | |
| 4,038,719 | A | 8/1977 | Bennett | |
| 4,045,026 | A | 8/1977 | Gillespie et al. | |
| D248,679 | S | 7/1978 | Rule | |
| 4,138,111 | A | 2/1979 | Rule | |
| 4,147,348 | A | 4/1979 | Lee | |
| 4,206,918 | A | 6/1980 | Lewis | |
| D263,248 | S | 3/1982 | Brine, Jr. | |

(Continued)

FOREIGN PATENT DOCUMENTS

| | | |
|---|---|---|
| CA | 1273662 | 9/1990 |

(Continued)

OTHER PUBLICATIONS

Victory Crosse sales literature (date and status as publication unknown).

*Primary Examiner*—Gene Kim
*Assistant Examiner*—M Chambers
(74) *Attorney, Agent, or Firm*—Paul, Hastings, Janofsky & Walker LLP

(57) ABSTRACT

An embodiment of the present invention provides an offset lacrosse head comprising a shaft, a collar, and a head. The collar defines an opening that receives the shaft. The head has a juncture. The juncture defines a socket that receives the collar, and the socket and the shaft are non-concentric. In a further aspect of this embodiment, the shaft has a shaft axis, the opening of the collar has an opening axis, the socket of the juncture has a socket axis, and at least one of the socket axis, the opening axis, and the shaft axis is offset, when viewed from a side elevation of the lacrosse stick facing an exterior of a sidewall of the head.

18 Claims, 6 Drawing Sheets

U.S. PATENT DOCUMENTS

| | | | | |
|---|---|---|---|---|
| 4,351,528 | A | 9/1982 | Duplin | |
| D273,601 | S | 4/1984 | Lewis, Jr. et al. | |
| 4,544,157 | A | 10/1985 | Curtis | |
| 4,657,260 | A | 4/1987 | Brine | |
| 4,659,080 | A | 4/1987 | Stoller | |
| 4,739,994 | A | 4/1988 | Lewis | |
| D297,963 | S | 10/1988 | Tucker et al. | |
| 4,940,243 | A | 7/1990 | Tucker et al. | |
| D318,509 | S | 7/1991 | Naumburg, Jr. | |
| 5,035,434 | A | 7/1991 | Taylor et al. | |
| 5,037,112 | A | 8/1991 | Brine et al. | |
| 5,054,790 | A | 10/1991 | Brine, III et al. | |
| 5,067,726 | A | 11/1991 | Brine, III et al. | |
| 5,080,372 | A | 1/1992 | Brine, III et al. | |
| D331,086 | S | 11/1992 | Brine, III et al. | |
| 5,290,039 | A | 3/1994 | Cornelio | |
| 5,335,909 | A * | 8/1994 | Green, Jr. | 473/305 |
| 5,494,297 | A | 2/1996 | MacNeil | |
| 5,568,925 | A | 10/1996 | Morrow et al. | |
| D376,183 | S | 12/1996 | Morrow et al. | |
| 5,935,026 | A * | 8/1999 | Dill et al. | 473/513 |
| 6,283,879 | B1 * | 9/2001 | Eden et al. | 473/513 |
| RE37,894 | E | 10/2002 | MacNeil | |
| 6,475,100 | B1 * | 11/2002 | Helmstetter et al. | 473/309 |
| 6,921,347 | B1 | 7/2005 | Morrow et al. | |
| 7,014,569 | B1 * | 3/2006 | Figgers | 473/288 |
| 2005/0282666 | A1 * | 12/2005 | Morrow | 473/513 |

FOREIGN PATENT DOCUMENTS

| | | |
|---|---|---|
| CA | 2322830 | 9/1999 |

* cited by examiner

400

400
500
404

504

500
404
504
604
600

600

604

OFFSET LACROSSE HEAD

This application claims the benefit of U.S. Provisional Application No. 60/600,794, filed Aug. 12, 2004, which is herein incorporated by reference in its entirety.

BACKGROUND

1. Field of the Invention

The present invention relates generally to lacrosse sticks, and more particularly, to a collar for providing an offset between the axis of a shaft and the socket axis of the juncture of a head attached to the shaft. The present invention also relates to a lacrosse stick head having a socket axis that provides an offset.

2. Background of the Invention

FIG. 1 illustrates a conventional lacrosse stick 100 having a handle 102 shown in dotted lines and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through the opening, or socket, defined by juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string holes 124 and a string laced through string holes 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

As shown in FIG. 1, the traditional means for attaching head 104 to handle or shaft 102 involves sliding shaft 102 into the socket defined by juncture 106 of head 104 and securing head 104 to shaft 102 with a screw or similar fastener placed in opening 107. In effect, the socket of juncture 106 serves as a female connection that receives shaft 102. In this configuration, the axis of handle 102 and the axis of the socket of juncture 106 are coincident.

A male plug that fits within the bore of shaft 102 could also be used, as suggested in U.S. Pat. No. 5,935,026 to Dill et al. With this connection, the shaft can be held onto the male plug by the friction fit between the components.

When double-wall synthetic lacrosse heads were first introduced, the early designs featured straight handles and straight heads, when viewed from a side elevation facing a sidewall of the head. In other words, the lacrosse head remained largely in line with the axis of the handle. Since those early designs, however, the trend has been to lower the lacrosse head below the handle axis. Lowering the head can enable better ball control and provide a player with an indication of the orientation of the lacrosse head, which results from the uneven weight distribution relative to the handle axis in directions radial to the handle axis.

SUMMARY OF THE INVENTION

An embodiment of the present invention provides a lacrosse stick having a shaft, a head, and a collar between the head and shaft. The collar is disposed within the juncture of the head. The shaft is disposed within the collar. The collar positions the shaft relative to the juncture such that the socket axis of the juncture is offset from the axis of the shaft, when viewed from a side elevation of the lacrosse stick facing the exterior of a sidewall of the lacrosse head, with the ball receiving side of the head facing upwards.

Another embodiment of the present invention provides a lacrosse stick having a shaft, a collar defining an opening that receives the shaft, and a head having a juncture. The juncture defines a socket that receives the collar, and the socket and the shaft are non-concentric. In a further aspect of this embodiment, the shaft has a shaft axis, the opening of the collar has an opening axis, the socket of the juncture has a socket axis, and at least one of the socket axis, the opening axis, and the shaft axis is offset, when viewed from a side elevation of the lacrosse stick facing an exterior of a sidewall of the head.

In an alternative embodiment, the collar has a male plug that is disposed, and preferably compressed, within the hollow shaft.

Another embodiment of the present invention provides a lacrosse head having an offset socket that provides an offset between the shaft axis and the axis defined by the exterior of the juncture and/or the remaining frame elements of the head, when viewed from a side elevation of the lacrosse stick facing the exterior of a sidewall of the lacrosse head.

DETAILED DESCRIPTION OF THE INVENTION

Figure 1:
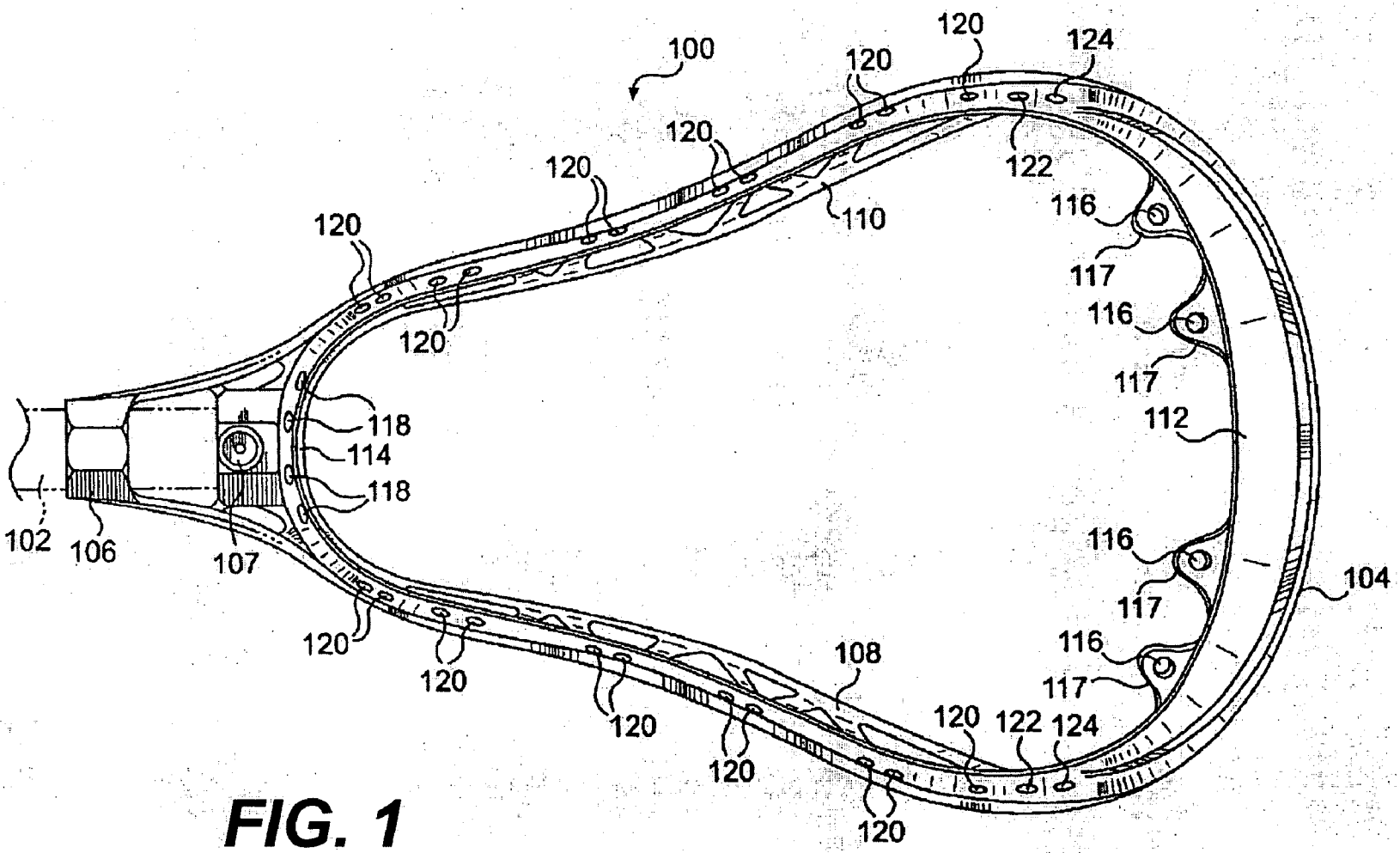
FIG. 1 PRIOR ART
FIG. 1 is a schematic diagram of a lacrosse stick.
Figure 2A:
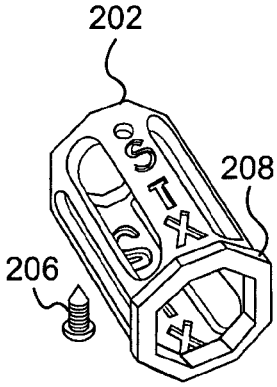
FIGS. 2A-C are schematic diagrams illustrating an isometric front view of a lacrosse stick having a lacrosse head, collar, and shaft, shown in different stages of assembly, according to an embodiment of the present invention.
Figure 2B:
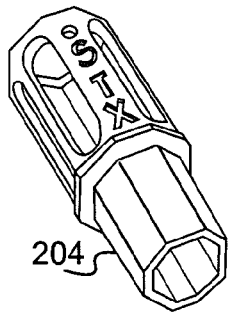
Figure 2C:
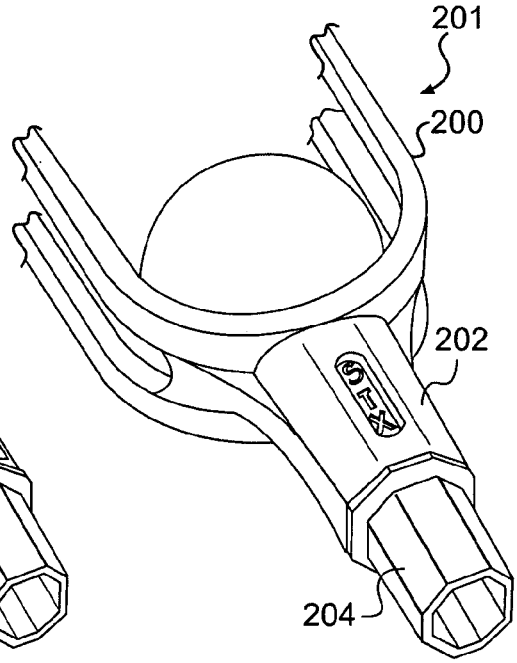

FIGS. 2A-C are schematic diagrams illustrating an isometric front view of a lacrosse stick 201 having a lacrosse head 200, collar 202, and shaft 204, shown in different stages of assembly, according to an embodiment of the present invention. As shown, collar 202 is placed on the end of shaft 204. The shaft 204 and collar 202 are then inserted into the socket defined by the juncture of head 200.

The friction fit between head 200, collar 202, and shaft 204 can adequately secure shaft 204 to head 200. As an example, collar 202 can be made of an elastic and compressible material, such as an elastomer, that stretches over shaft 204 and compresses within head 200 to provide a strong friction fit. Optionally, the shaft 204, collar 202, and head 200 are further secured with a fastener 206 (e.g., a screw) disposed in aligned openings of each component. In an alternative embodiment, a quick-release fastener, such as a spring-loaded bearing, secures the shaft 204, collar 202, and/or head 200 together. Quick-release couplings, such as the friction fit or the quick-release fastener, would enable a player to rapidly and conveniently adjust the offset of a lacrosse head to achieve desired performance characteristics during practice and competitive play.

As shown best in FIG. 2A, collar 400 can also include a flange 208 that mates with a corresponding structure of the juncture of head 200, such as an outside edge, an inset lip, or a groove. FIG. 2C illustrates one example of this aspect, with flange 208 mating flush with the leading edge of the juncture of head 200.

Collar 202 provides an offset between the axis of shaft 204 and the socket axis of the juncture of head 200, when viewed from a side elevation of the lacrosse stick facing the exterior of a sidewall of head 200, with the ball receiving side of the head facing upwards. In this example, the offset is approximately 3°. The offset could, of course, vary depending on the desired performance characteristics of the lacrosse stick. The axis of shaft 204 is determined by the portion of the shaft that is disposed inside of collar 202 and extends linearly from collar 202. The socket axis of the juncture of head 200 is determined by the socket that receives the collar 202. The exterior of the collar 202 mates with the interior surface of the socket. The axis defined by the exterior of the collar (referred to herein as the exterior collar axis) is therefore coincident with the socket axis of the juncture of head 200.

In another aspect of the present invention, the offset between the axis of shaft 204 and the socket axis of the juncture of the head 200 is expressed in terms of concentricity, wherein concentric as used herein means having the same axis. For example, shaft 204 and the socket of the juncture of head 200 are non-concentric to provide the offset. The opening in collar 202 can also be non-concentric with the exterior of collar 202 and the socket of the juncture of head 200. As one of ordinary skill in the art would appreciate, no particular shape of the socket, collar, or shaft is required to provide a non-concentric configuration, and could include, for example, round shapes, oval shapes, or octagonal shapes.

Figure 3A:
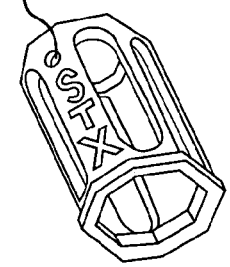
FIGS. 3A-C are schematic diagrams illustrating an isometric back view of the lacrosse stick shown in FIGS. 2A-C.
Figure 3B:
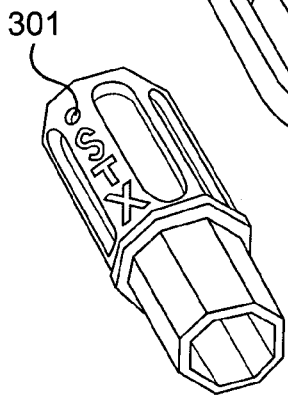
Figure 3C:
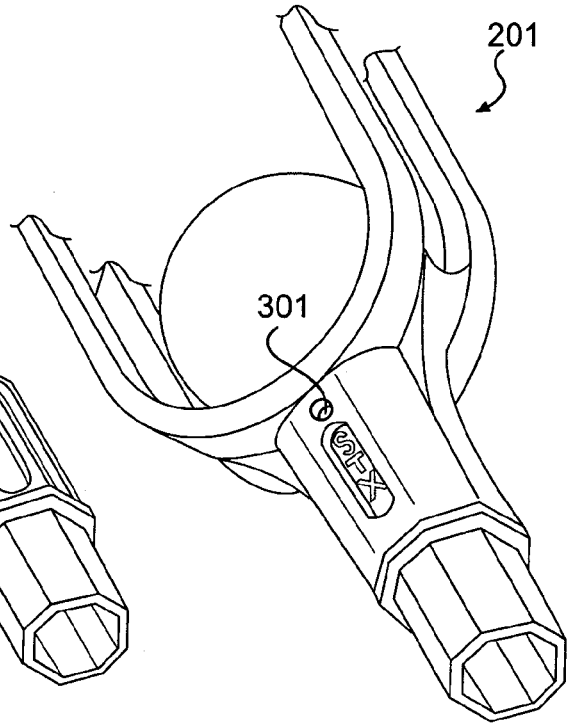

FIGS. 3A-C are schematic diagrams illustrating an isometric back view of the lacrosse stick 201 shown in FIGS. 2A-C. These views illustrate the exemplary aligned openings 301 that receive fastener 206.

Figure 4C:
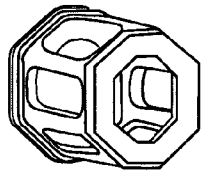
FIGS. 4A-C are schematic diagrams illustrating isometric views of the front and back sides of a 3° offset collar, with and without a shaft inserted, according to an embodiment of the present invention.
Figure 4B:
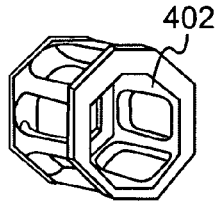
Figure 4A:
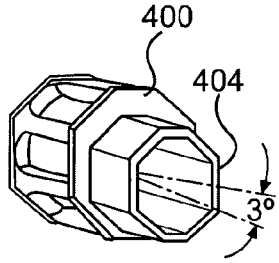

FIGS. 4A-C are schematic diagrams illustrating isometric views of the front and back sides of a 3° offset collar 400, according to an embodiment of the present invention. FIG. 4A illustrates a shaft 404 disposed in collar 400. FIG. 4B illustrates a view of the front side of collar 400 and the opening 402 through which shaft 404 enters. FIG. 4C illustrates a view of the back side of collar 400, which provides a wall against which shaft 404 abuts, and which is the side that first enters the socket of a juncture of a lacrosse head.

As shown best in FIG. 4B, the opening 402 in collar 400 that receives a shaft 404 is off-center at the front face of collar 400, with the opening disposed toward the bottom of the front face of collar 400. In this manner, the front face of collar 400 is wider at the top and narrower at the bottom. From this lowered, off-center position, opening 402 within collar 400 rises as it extends toward the opposite side of collar 400. Opening 402 is therefore canted with respect to the exterior of collar 400, which creates the 3° offset between the axis of shaft 404 (which is coincident with the axis of opening 402) and the axis defined by the exterior of collar 400.

Figure 5C:
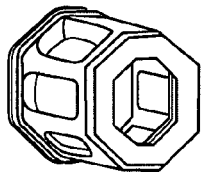
FIGS. 5A-C are schematic diagrams illustrating isometric views of the front and back sides of a 1.5° offset collar, with and without a shaft inserted, according to an embodiment of the present invention.
Figure 5B:
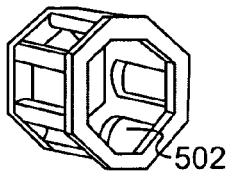
Figure 5A:
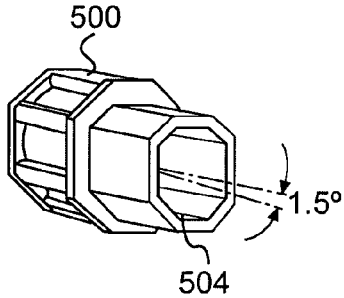

FIGS. 5A-C are schematic diagrams illustrating isometric views of the front and back sides of a 1.5° offset collar 500, according to an embodiment of the present invention. As shown, collar 500 is similar in most respects to collar 400 of FIGS. 4A-4C except for the degree to which the opening 502 of collar 500 is off-center at the front face of collar 500. The front face of collar 500 at its bottom is slightly wider than the front face of collar 400 at its bottom. In addition, opening 502 rises at an angle slightly closer to horizontal than the angle of opening 402. Opening 502 is canted with respect to the exterior of collar 400 at this more slightly horizontal angle, which creates the 1.5° offset between the axis of shaft 504 (which is coincident with the axis of opening 502) and the axis defined by the exterior of collar 500.

Figure 6C:
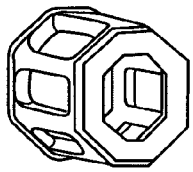
FIGS. 6A-C are schematic diagrams illustrating isometric views of the front and back sides of a straight collar that provides no offset (i.e., 0° offset), with and without a shaft inserted, according to an embodiment of the present invention.
Figure 6B:
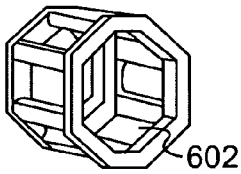
Figure 6A:
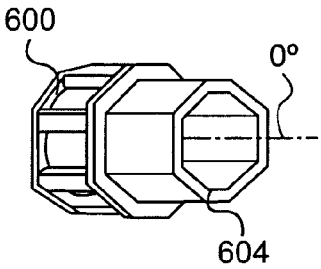

FIGS. 6A-C are schematic diagrams illustrating isometric views of the front and back sides of a straight collar 600 that provides no offset (i.e., 0° offset), according to an embodiment of the present invention. As shown in this example, opening 602 is centered at the front face of collar 600. As opening 602 extends toward the back side of collar 600, it remains centered. Therefore, the axis of shaft 604 (which is coincident with the axis of opening 602) and the axis defined by the exterior of collar 600 remain coincident such that no offset exists.

An embodiment of the present invention uses the three different collars of FIGS. 4A-6C with the same shaft and head. In this manner, the shaft and head can be modified to provide different offsets (e.g., 3°, 1.5°, and 0°) between the shaft axis and the socket axis of the juncture of the head. Optionally, the collars have indicia, such as numeric markings and/or color coding, to indicate the degree of offset. For example, a yellow collar could indicate a 3° offset, a red collar could indicate a 1.5° offset, and a blue collar could indicate a 0° offset.

In one embodiment, the size of the collar accommodates the typical sizes of juncture sockets on lacrosse heads and the size of the shaft is reduced from the typical size to enable the shaft to be inserted into the collar. Optionally, an adapter could be used to reduce the size (e.g., as measured by the cross sectional area) of the typical shaft, in which case the shaft would be coupled with the adapter and the adapter would be inserted into the collar.

In another embodiment, the collar is sized to accept a shaft of a typical size, and the juncture of the head is oversized to accept the collar.

Figures 7A, 7B, 8A, 8B, 9A, 9B:
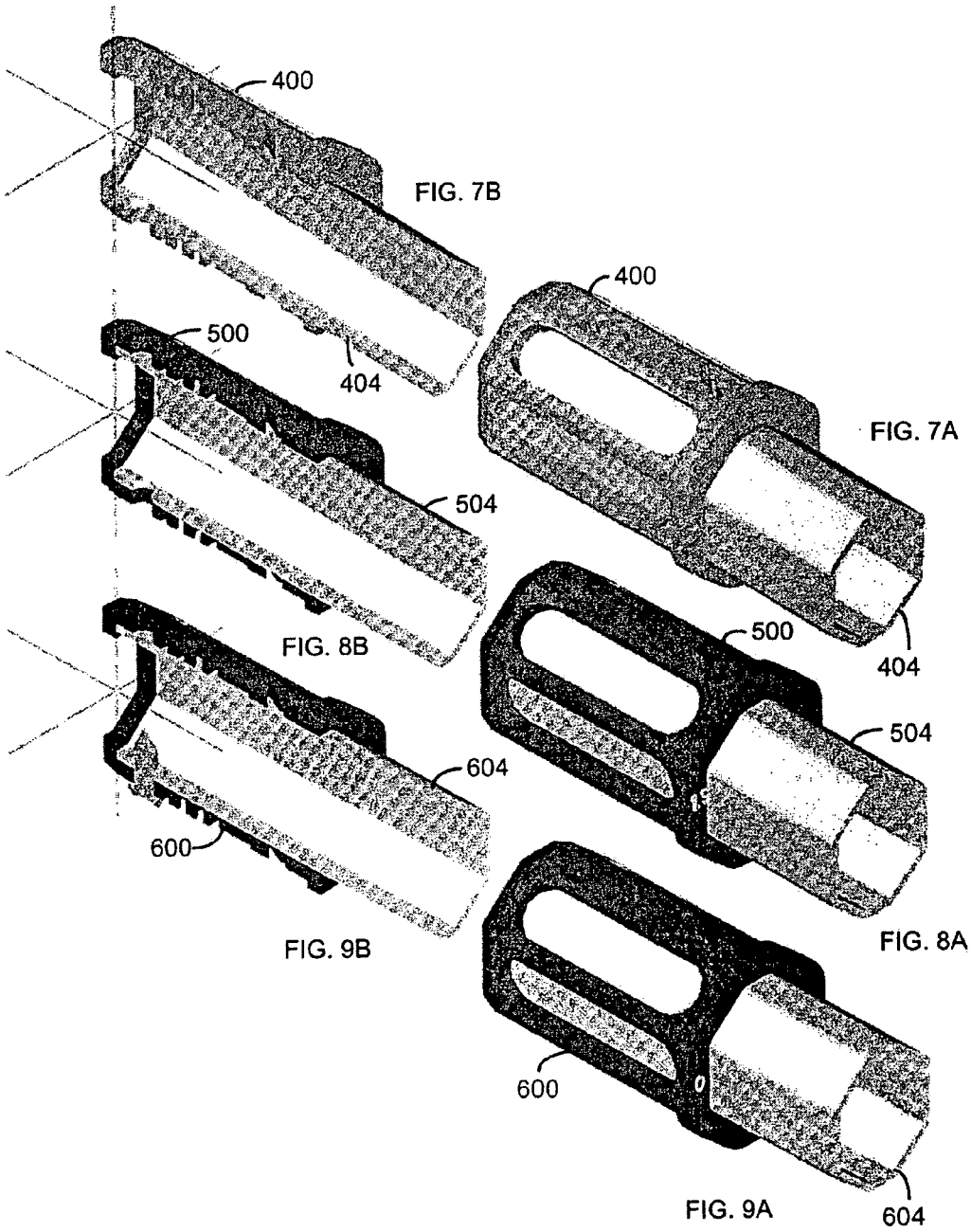
FIGS. 7A and 7B are schematic diagrams illustrating an isometric view and an isometric cross sectional view, respectively, of the 3° offset collar shown in FIGS. 4A-C.
FIGS. 8A and 8B are schematic diagrams illustrating an isometric view and an isometric cross sectional view, respectively, of the 1.5° offset collar shown in FIGS. 5A-C.
FIGS. 9A and 9B are schematic diagrams illustrating an isometric view and an isometric cross sectional view, respectively, of the straight collar shown in FIGS. 6A-C.

FIGS. 7A and 7B are schematic diagrams illustrating an isometric view and isometric cross sectional view, respectively, of the 3° offset collar 400 shown in FIGS. 4A-C. These views illustrate further how the shaft 404 is canted with respect to the exterior of collar 400.

FIGS. 8A and 8B are schematic diagrams illustrating an isometric view and isometric cross sectional view, respectively, of the 1.5° offset collar 500 shown in FIGS. 5A-C. These views illustrate further how the shaft 504 is canted with respect to the exterior of collar 500.

FIGS. 9A and 9B are schematic diagrams illustrating an isometric view and isometric cross sectional view, respectively, of the straight collar 600 shown in FIGS. 6A-C. These views illustrate further how the shaft 604 is coincident with the exterior of collar 600.

Figure 10:
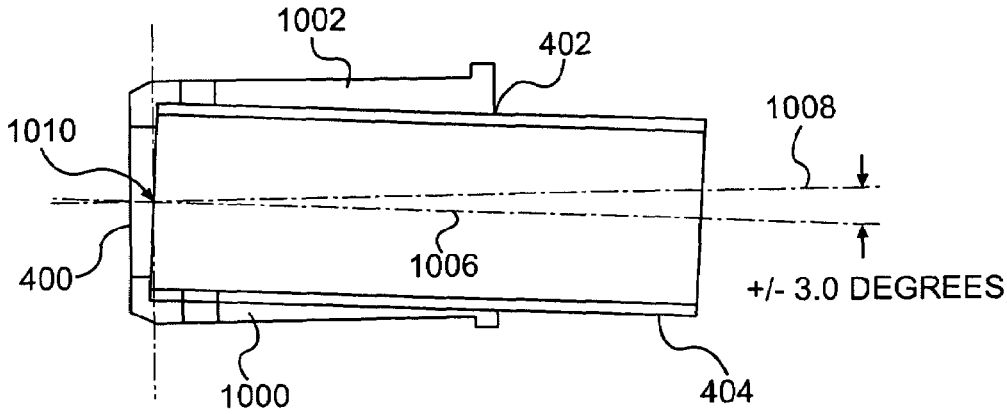
FIG. 10 is a schematic diagram illustrating a cross sectional side view of the 3° offset collar shown in FIGS. 4A-C with the shaft inserted.

FIG. 10 is a schematic diagram illustrating a cross sectional side view of the 3° offset collar 400 shown in FIGS. 4A-C with the shaft 404 inserted. This view illustrates how opening 402 and shaft 404 rise within collar 400 toward the back side of collar 400. As shown, in this direction, the bottom wall 1000 of collar 400 increases in thickness, while the top wall 1002 decreases in thickness.

FIG. 10 illustrates the 3° offset between the axis 1006 of shaft 404 and the axis 1008 defined by the exterior of collar 400 (referred to herein as the exterior collar axis 1008), when viewed from a side elevation of the lacrosse stick facing the exterior of a sidewall of the lacrosse head. When inserted into a socket of a juncture of a head, exterior collar axis 1008 would be coincident with the socket axis. In this exemplary collar 400, pivot point 1010 is the point at which the shaft axis 1006 and the exterior collar axis 1008 cross.

Figure 11:
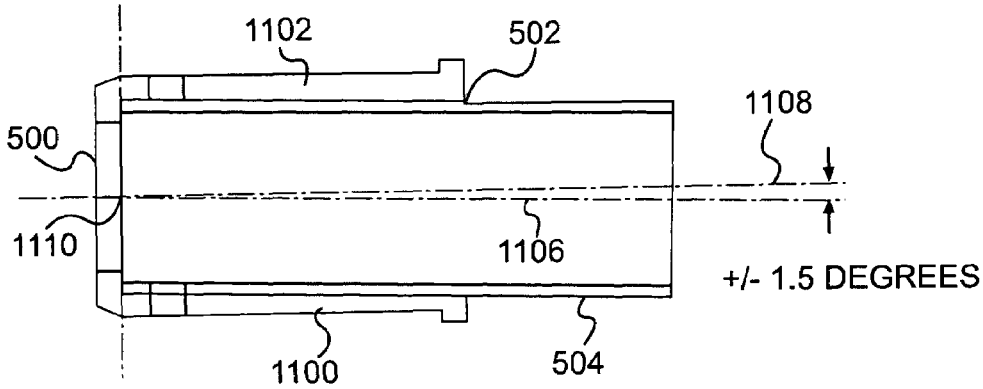
FIG. 11 is a schematic diagram illustrating a cross sectional side view of the 1.5° offset collar shown in FIGS. 5A-C with the shaft inserted.

FIG. 11 is a schematic diagram illustrating a cross sectional side view of the 1.5° offset collar 500 shown in FIGS. 5A-C with the shaft 504 inserted. This view illustrates how opening 502 and shaft 504 rise within collar 500 toward the back side of collar 500. As shown, in this direction, the bottom wall 1100 of collar 500 increases in thickness, while the top wall 1102 decreases in thickness. Compared to collar 400 of FIG. 10, collar 500 of FIG. 11 disposes shaft 504 at a slightly more horizontal angle, as evident from the bottom wall 1100 of collar 500 at the front face of collar 500 being slightly thicker than the bottom wall 1000 of collar 400 at its front face, and the top wall 1102 of collar. 500 at the front face of collar 500 being slightly thinner than the top wall 1002 of collar 400 at its front face.

FIG. 11 illustrates the 1.5° offset between the axis 1106 of shaft 504 and the exterior collar axis 1108 of collar 500, when viewed from a side elevation of the lacrosse stick facing the exterior of a sidewall of the lacrosse head. When inserted into a socket of a juncture of a head, exterior collar axis 1108 would be coincident with the socket axis. In this exemplary collar 500, pivot point 1110 is the point at which the shaft axis 1106 and the exterior collar axis 1108 cross.

Figure 12:
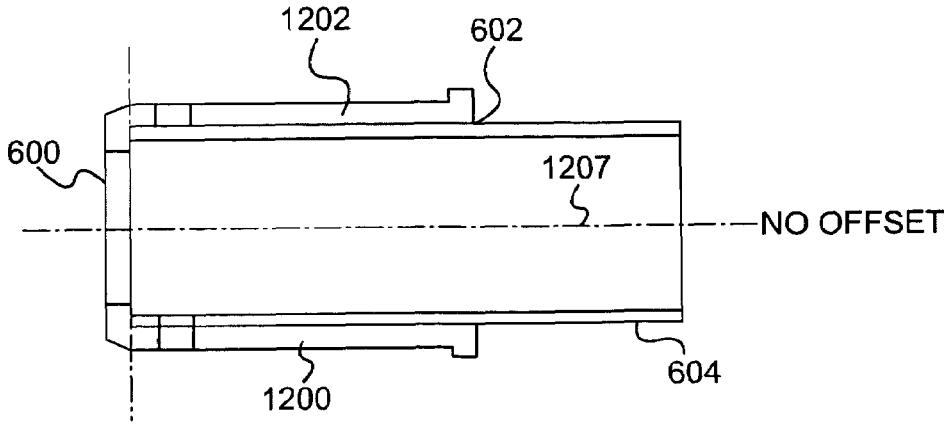
FIG. 12 is a schematic diagram illustrating a cross sectional side view of the straight collar shown in FIGS. 6A-C with the shaft inserted.

FIG. 12 is a schematic diagram illustrating a cross sectional side view of the straight collar 600 shown in FIGS. 6A-C with the shaft 604 inserted. This view illustrates how the axes 1207 of shaft 604, the opening 602 of collar 600, and the exterior of collar 600 are coincident, when viewed from a side elevation of the lacrosse stick facing the exterior of a sidewall of the lacrosse head. In this case, the thicknesses of bottom wall 1200 and top wall 1202 are constant.

As shown in FIGS. 2A-12, a collar according to the present invention can connect a lacrosse stick shaft to a lacrosse stick head. The collar can include a first end face defining a first end of an opening adapted to receive an end of a shaft, and a second end face having a wall adapted to restrain the end of the shaft within the opening. Collar can have a longitudinal body, which has an exterior longitudinal surface defining an exterior collar axis. The opening can extend from the first end face to the wall of the second end face and define an opening axis. The exterior collar axis can be offset from the opening axis, when viewed from a side elevation view according to which the collar connects the shaft to the head, where the side elevation view faces an exterior of a sidewall of the head.

In a further aspect of the present invention, the longitudinal body has an uppermost wall and a lowermost wall when viewed from the side elevation, and the uppermost wall decreases in thickness from the first end face to the second end face, while the lowermost wall increases in thickness from the second end face to the second end face.

In a further aspect of the present invention, the exterior collar axis is offset from the opening axis by approximately 1.5° or approximately 3°.

A further aspect of the present invention includes a quick-release coupling disposed in a fastener opening defined by the longitudinal body. The fastener opening can be adapted to align with aligned openings in the shaft and the head.

In a further aspect of the present invention, the longitudinal body has an octagonal shape, an oval shape, a teardrop shape, an asymmetrical shape, or a cylindrical shape.

Figure 13:
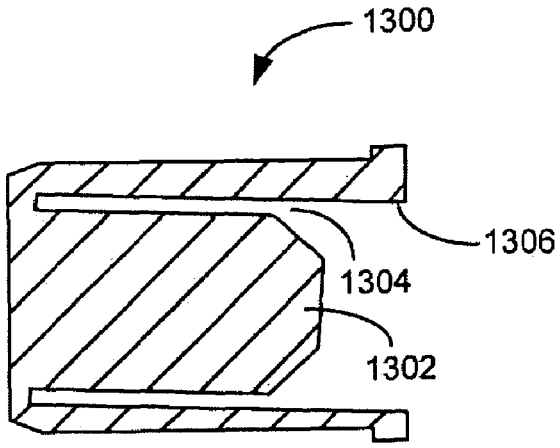
FIG. 13 is a schematic diagram illustrating a cross sectional side view of an offset collar having a male plug, according to an alternative embodiment of the present invention.

In an alternative embodiment of the present invention, a collar has a male plug that is disposed, and preferably compressed, within the hollow shaft. FIG. 13 is a schematic diagram illustrating a cross sectional side view of an offset collar 1300 having a male plug 1302, according to this alternative embodiment of the present invention. Male plug 1302 is preferably compressible within a shaft, for example, including compressible ribs. The ribs can fit into and compress within a hollow shaft. When assembled, the shaft wall is disposed in the gap 1304 between the male plug 1302 and the inside wall 1306 of the offset collar 1300.

Collar 1300 provides an offset between the shaft axis and the socket axis of the juncture of the head. The male plug 1302 fits within the hollow bore of a shaft. The male plug 1302 preferably includes compressible members (e.g., ribs) that can provide a snug friction fit with shafts having a range of different bore dimensions. To further secure the shaft, collar, and head together, a fastener is preferably placed through aligned openings of each. In this configuration, the shaft is held securely in place by the friction fit of the male plug 1302 inside the shaft, the friction fit of the shaft in the offset collar 1300, the friction fit of the offset collar 1300 in the head, and the fastener. Additional embodiments and benefits of the male plug are described in application Ser. No. 10/630,856, filed Jul. 31, 2003, now U.S. Pat. No. 6,916,259, issued Jul. 12, 2005, which is herein incorporated by reference in its entirety.

Although the figures illustrate offset collars suitable for roughly octagonal-shaped shafts, it should be understood that an offset collar according to the present invention could be adapted to fit any variety of shaft shapes, such as teardrop, asymmetrical, and oval. Indeed, the offset collar of the present invention could be adapted to accommodate a cylindrical shaft or a shaft having any number of sides.

Examples of suitable materials for an offset collar according to the present invention include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene(EPDM), and polyvinyl chloride (PVC).

Although FIGS. 2A-13 illustrate the use of a collar to provide the offset between the shaft axis and the socket axis of the juncture of the head, one of ordinary skill in the art would appreciate that the juncture itself (without the use of a separate collar) could provide an offset. In other words, the interior open volume of the juncture in which the shaft is disposed could be configured as is the interior of the collars shown in the above embodiments.

Figure 14:
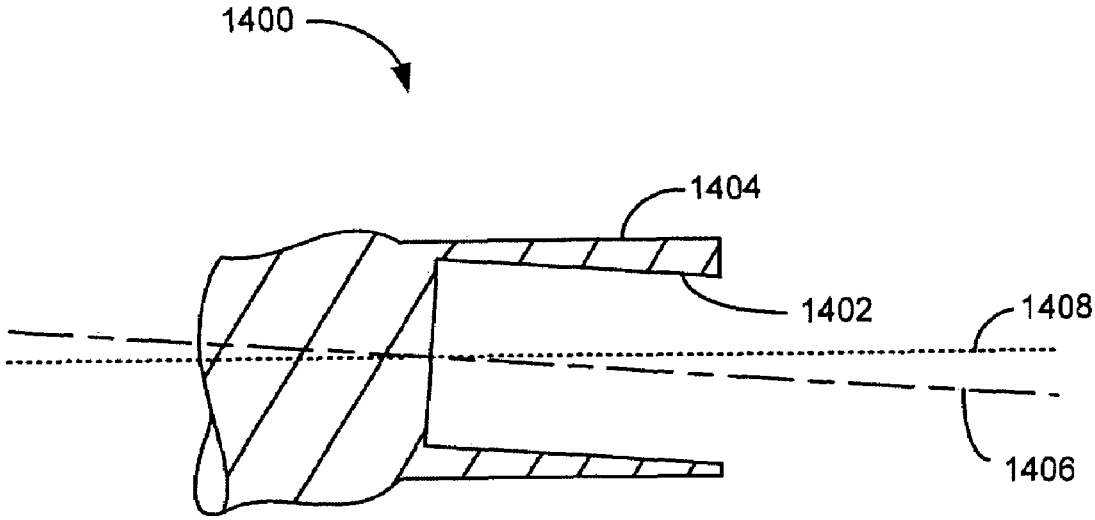
FIG. 14 is a schematic diagram illustrating a partial cross sectional side view of a lacrosse stick head having an offset socket, according to an alternative embodiment of the present invention.

FIG. 14 illustrates this alternative embodiment, in which a head 1400 has an offset socket 1402. The longitudinal body 1404 of the juncture is aligned with the head 1400 and has an axis 1406. The offset socket 1402 has an axis 1408, which coincides with the axis of the shaft that is disposed in the offset socket 1402. As shown, the configuration of the offset socket 1402 relative to the longitudinal body 1404 (and the remaining frame elements of head 1400) provides an offset between the shaft axis (coinciding with socket axis 1406) and the axis 1408 defined by the longitudinal body 1404 and head 1400.

Similar to the collar embodiments described above, socket axis 1406 of head 1400 of FIG. 14 can be offset from the longitudinal body axis 1408 by, for example, approximately 1.5° or approximately 3°. In this configuration, the socket rises within the juncture in a direction from the end of the juncture toward the frame, when viewed from the side elevation of the head facing the exterior of a sidewall of the head, with the ball receiving side of the head facing upwards. The uppermost wall of the longitudinal body 1404 decreases in thickness from the end of the juncture toward the frame while the lowermost wall increases in thickness from the end of the juncture toward the frame. In a preferred embodiment, head 1400 is fully injection molded to provide the offset socket 1402.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse stick comprising:

a shaft;

a collar defining an opening that receives the shaft, a distal portion of the shaft disposed inside the opening radially within the collar; and a head having a juncture, the juncture defining a socket that receives the collar, the distal portion of the shaft and the collar disposed radially within the socket, and the socket and the distal portion of the shaft being non-concentric, wherein the distal portion of the shaft having a shaft axis, the opening of the collar has an opening axis, the socket of the juncture has a socket axis, and at least one of the socket axis, the opening axis, and the shaft axis is offset, when viewed from a side elevation of the lacrosse stick facing an exterior of a sidewall of the head, and wherein the socket axis is offset from the opening axis by one of approximately 1.5° and approximately 3°.

2. The lacrosse stick of claim 1, the opening axis and the shaft axis being coincident.

3. The lacrosse stick of claim 1, the collar having a first end and a second end, the shaft entering the opening at the first end, and the opening rising from the first end to the second end within the collar, when viewed from a side elevation of the head facing an exterior of a sidewall of the head, with the ball receiving side of the head facing upwards.

4. The lacrosse stick of claim 1, the collar having a lowermost wall, the thickness of the lowermost wall increasing from the first end to the second end.

5. The lacrosse stick of claim 4, the collar having an uppermost wall, the thickness of the uppermost wall decreasing from the first end to the second end.

6. The lacrosse stick of claim 1, the exterior of the collar defining an exterior collar axis, and the exterior collar axis and the socket axis being coincident.

7. The lacrosse stick of claim 1, further comprising a fastener disposed in aligned openings through the shaft, the collar, and the head.

8. The lacrosse stick of claim 7, the fastener comprising a quick-release fastener.

9. The lacrosse stick of claim 1, the shaft secured to the collar by a friction fit, and the collar secured to the head by a friction fit.

10. The lacrosse stick of claim 9, the collar comprising an elastic and compressible material that stretches over the shaft and compresses within the head.

11. The lacrosse stick of claim 10, the collar comprising an elastomer.

12. The lacrosse stick of claim 1, the shaft and the opening having one of an octagonal shape, an oval shape, a teardrop shape, an asymmetrical shape, and a cylindrical shape.

13. The lacrosse stick of claim 1, the collar comprising a first collar, the socket axis being offset from the opening axis at a first angle, and the lacrosse stick further comprising:

a second collar, the second collar defining a second opening adapted to receive the distal portion of the shaft, the second opening having a second opening axis, and when the distal portion of the shaft is received in the second collar, the second opening axis and the shaft axis are coincident, and the socket axis is offset from the second opening axis at a second angle different from the first angle of the first collar, when viewed from a side elevation of the lacrosse stick facing an exterior of a sidewall of the head, and the first collar and the second collar being interchangeable between the shaft and the head.

14. The lacrosse stick of claim 13, the first collar having indicia of the first angle and the second collar having indicia of the second angle.

15. The lacrosse stick of claim 14, the indicia of the first collar and the second collar comprising one of different numerals and different colors.

16. The lacrosse stick of claim 13, further comprising:

a third collar, the third collar defining a third opening adapted to receive the distal portion of the shaft, the third opening having a third opening axis, and when the distal portion of the shaft is received in the third collar, the second opening axis, the shaft axis, and the socket axis are coincident, when viewed from a side elevation of the lacrosse stick facing an exterior of a sidewall of the head, and the first collar, the second collar, and the third collar being interchangeable between the shaft and the head.

17. The lacrosse stick of claim 1, the shaft further comprising an adapter that reduces the cross-sectional area of the shaft to fit within the opening of the collar.

18. The lacrosse stick of claim 1, the head further comprising a pocket.

* * * * *